US006557844B2

(12) United States Patent
Becker et al.

(10) Patent No.: US 6,557,844 B2
(45) Date of Patent: May 6, 2003

(54) DEVICE FOR TRANSFERRING SHEETS

(75) Inventors: Willi Becker, Bammental (DE); Daniel Conzelmann, Dielheim (DE); Andreas Fricke, Eberbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 106 days.

(21) Appl. No.: 09/827,714

(22) Filed: Apr. 6, 2001

(65) Prior Publication Data

US 2001/0033784 A1 Oct. 25, 2001

(30) Foreign Application Priority Data

Apr. 6, 2000 (DE) ..... 100 17 124

(51) Int. Cl.[7] ..... B65H 29/06

(52) U.S. Cl. ..... 271/82; 271/314; 74/567; 74/570

(58) Field of Search ..... 271/82, 314; 74/567, 74/568 R, 570, 571 L

(56) References Cited

U.S. PATENT DOCUMENTS 3,649,057 A * 3/1972 Urciola ..... 403/16
3,742,847 A * 7/1973 Zimmermann et al. ..... 101/230
4,098,187 A * 7/1978 Wirz ..... 101/410
4,122,773 A * 10/1978 Wirz ..... 101/230
4,535,691 A * 8/1985 Kida ..... 101/230
4,993,702 A * 2/1991 Jackson ..... 271/270
5,048,366 A * 9/1991 Spanio ..... 74/567
5,218,882 A * 6/1993 Jacobson ..... 74/567
5,721,449 A * 2/1998 Panuce ..... 200/16

FOREIGN PATENT DOCUMENTS

DE 79 27 115 2/1980

* cited by examiner

*Primary Examiner*—Patrick H. Mackey
(74) *Attorney, Agent, or Firm*—Laurence A. Greenberg; Werner H. Stemer; Gregrory L. Mayback

(57) ABSTRACT

A device for transferring sheets in a sheet-processing machine includes a cylinder having at least one gripper device for the sheets, and a control device for opening and closing the gripper device, the control device having a first control cam for recto printing and a second control cam for recto/verso printing, at least one follower element for following the first and second control cams, each of the first and second control cams being formed with a through opening for accommodating a bearing element and, respectively, a cutout formed in the periphery of the first and second control cams and extending as far as the through opening for fitting the first and second control cams to and removing them from the bearing element radially. The first and second control cams, respectively, are of unipartite construction and, in peripheral direction, are aligned with one another so as to provide an at least approximately closed contour path for the at least one follower element.

19 Claims, 5 Drawing Sheets

69
27
53
49
23
51
61
45
R1
R2
B2
67
55
7
35
65
21
13
R3
R4
21
5
63
B1
15
1
37
59
33
57
35
30
31
19
47
3
17
29
53
25

69
27
7
49
23
51
57
65
61
13
63
5
1
19
15
55
31
59
29
3
25

1
13
63
19
61
49
27
7
57
69
53
51
23
65
5
15
55
59
3
29
31
25

DEVICE FOR TRANSFERRING SHEETS

BACKGROUND OF THE INVENTION

Field of the Invention

The invention relates to a device for transferring sheets in a sheet-processing machine, in particular a sheet-fed printing machine, having a cylinder with at least one gripper device for the sheets, and with a control device for opening and closing the gripper device.

In transfer devices of the type referred to herein, which include at least one cylinder having a gripper device by the periphery of which a sheet, for example, a paper sheet, is transferred, the opening and closing of the gripper device holding the sheet at the leading edge thereof is performed based upon the rotary angle position of the cylinder. Provided for this purpose is a control device, which includes at least one control cam completely enclosing a bearing journal of the cylinder and having an outer contour followed by a follower element coupled to the gripper device. In this case, the follower element is supported continuously on the closed curved path of the control cam. The control cam is disposed in a fixed position with respect to the rotating cylinder, for example, fastened to a side wall of the machine, and is formed with a through opening through which the bearing journal extends.

The assembly or mounting of the control cam is normally readily possible before the cylinder is inserted, in that it is pushed onto the bearing journal. The adjustment for setting the gripper opening/closing times is achieved by rotating the control cam with respect to the side wall which is in a fixed position, so that format adjustment of the sheets is possible. It has been shown that the control cam, for example, as a result of failure of the follower element, for example, because of a lack of lubrication or due to a fault in the material, can be damaged, which makes the replacement thereof necessary. One possibility for sliding the control cam down off the bearing journal in the axial direction requires the removal of the side wall, which is possible only with a very great amount of effort. One further possibility is to break the control cam, which again is made more difficult by the poor accessibility thereof. Use has therefore already been made, even during initial assembly or mounting, of divided control cams, which are detachably connected to one another. A disadvantage here is that the fabrication, assembly or mounting and adjustment of the multipartite control cam is very complicated and therefore costly.

The published German Patent Document GM 79 27 115 U1 reveals a transfer device which has a multipartite control cam. As viewed in cross section, the control cam has a U-shaped basic body, which can be pushed over the bearing journals in radial direction with respect to the axis of rotation of the cylinder. In order to implement a closed cam path, the open region of the basic body is then supplemented by a short cam segment, which is pinned and screwed to the basic body. A disadvantage thereof is that the production and assembly/disassembly or mounting/removal of the control cam is very complicated.

In addition, U.S. Pat. No. 4,535,691 discloses a transfer device that is installed in sheet-fed printing machines, which are capable of being operated selectively or optionally in recto or first-form printing and in recto/verso or first-form and perfector printing. For this purpose, the opening range of the gripper device, i.e., the rotary angle position of the cylinder wherein the gripper device is opened, up to the rotary angle position of the cylinder at which it is closed again in order to release the sheet, is constructed so as to be adjustable, while the closing range of the gripper device, in order to accept the sheet from a preceding printing unit, for example, is always the same. For this purpose, a control device is used which has two control cams, a first, fixed-position control cam for performing the complete guidance of the follower element in the recto printing operation, while a second control cam, which can be adjusted in the peripheral direction with respect to the first control cam, is located in a nonfunctioning waiting position during the recto printing operation. In recto/verso of first-form and perfector printing, the second control cam is adjusted in order to shift the opening time of the gripper device. In this case, the first and the second control cams then provide one movement section, respectively. A disadvantage of this construction is that the first control cam used for recto printing must be of closed construction, the assembly and disassembly or mounting and removal of the control cam being made more difficult in the case of a unipartite configuration, and the manufacture of the control cam being costly in the case of a multipartite configuration thereof.

SUMMARY OF THE INVENTION

It is therefore an object of the invention to provide a transfer device of the type mentioned at the introduction hereto wherein, even with the cylinder already assembled or mounted, the at least one control cam can be assembled and disassembled or mounted and removed simply and thus, preferably, can be produced simply and therefore cost-effectively.

With the foregoing and other objects in view, there is provided, in accordance with the invention, a device for transferring sheets in a sheet-processing machine, comprising a cylinder having at least one gripper device for the sheets, and a control device for opening and closing the gripper device, the control device having a first control cam for recto printing and a second control cam for recto/verso printing, at least one follower element for following the first and second control cams, each of the first and second control cams being formed with a through opening for accommodating a bearing element and, respectively, a cutout formed in the periphery of the first and second control cams and extending as far as the through opening for fitting the first and second control cams to and removing them from the bearing element radially, the first and second control cams, respectively, being of unipartite construction and, in peripheral direction, being aligned with one another so as to provide an at least approximately closed contour path for the at least one follower element.

In accordance with another feature of the invention, at least one of the first and second control cams is rotatable with respect to the other thereof for adjusting opening and closing times of the gripper device.

In accordance with a further feature of the invention, the cutout formed in at least one of the first and the second control cams has a width which is at least as large as the outer diameter of the bearing element, and is at maximum only sufficiently large for a wall defining said through opening to be interrupted by the cutout over a peripheral range of less than 180°.

In accordance with an added feature of the invention, the gripper device is actuatable by the follower element, and the cutout in the first control for recto printing is disposed in a peripheral region wherein the gripper device actuatable by the follower element is inactive during recto printing.

In accordance with an additional feature of the invention, the first and second control cams are formed and aligned with one another in a manner that guide paths thereof for the follower element, in recto printing and recto/verso printing, overlap in at least one peripheral region of the first and second control cams.

In accordance with yet another feature of the invention, the transfer device includes an actuating drive for aligning the first and the second control cams with one another in peripheral direction.

In accordance with yet a further feature of the invention, the transfer device includes structure provided for manually performing the alignment of the first and the second control cams with one another in peripheral direction.

In accordance with yet an added feature of the invention, the first control cam is fixed to a frame fixed in position, and the second control cam is adjustable in peripheral direction with respect to the first control cam.

In accordance with yet an additional feature of the invention, the second control cam has a toothing system, and the actuating drive has at least one gearwheel to which a torque is applicable and which is one of being engaged with and being engageable with the toothing system.

In accordance with still another feature of the invention, the first and the second control cams, respectively, have at least two outer peripheral sections with different radii, a transition from one of the outer peripheral sections to another of the outer peripheral sections disposed adjacent thereto being at least approximately stepless.

In accordance with still a further feature of the invention, the outer peripheral sections are circular path sections.

In accordance with still an added feature of the invention, the transfer device includes at least one stop for defining at least one of a maximum opening position and a closing position of the gripper device.

In accordance with still an additional feature of the invention, the cylinder is a storage cylinder.

In accordance with another feature of the invention, the cylinder is a storage impression cylinder.

In accordance with a further feature of the invention, the transfer device forms part of a sheet turning or reversing device which, as viewed in the sheet travel direction, has a transfer/turning or reversing drum disposed downline from the cylinder.

In accordance with an added feature of the invention, the follower element is formed by at least two cam rollers disposed adjacent one another, a first one of the cam rollers following the first control cam, and a second one of the cam rollers following the second control cam.

In accordance with an additional feature of the invention, the follower element is formed by a wide cam roller for following both the first and the second control cams.

In accordance with yet another feature of the invention, the cam roller is of double convex form and, in the peripheral regions, the cam roller rests on contour paths of the first and the second control cams.

In accordance with a concomitant feature of the invention, the first and the second control cams, respectively, in the peripheral direction, upline and downline from the cutout thereof, have a lowered portion with respect to the outer peripheral surface of the respective other control cam.

Thus, in order to attain the objective of the invention, a device for transferring sheets in a sheet-processing machine is proposed which has a cylinder with at least one gripper device for the sheets, the opening and closing and/or the times for opening and closing the gripper device in relation to the rotary angle position of the cylinder being performed or being adjustable by a control device. The control device has a first control cam for recto printing and a second control cam for recto/verso printing, both cams being followed by at least one follower element, for example a cam roller. The control cams, respectively, are formed with a through opening for accommodating a bearing element, in particular a bearing journal, of the cylinder and, in each case, a cutout provided in the periphery of the control cams and extending as far as the through opening to permit the control cam to be fitted to and removed from the bearing element radially. Each control cam, viewed by itself, respectively, therefore has no closed outer contour, i.e., a contour track, which can be followed by the follower element. The width of the cutout is at least as great as or greater than the outer diameter of the bearing element. The transfer device is distinguished by the fact that the first and second control cams are formed in one piece and, in the peripheral direction, are aligned with one another so that there results a preferably completely closed, but at least approximately closed, contour path for the follower element. Because of the single part or integral configuration, the control cams can be produced cost-effectively. It is also advantageous that the mounting and removal or assembly and disassembly are also readily possible even if the cylinder has already been installed in the machine.

The contour path which can be followed is composed of the guide paths interrupted by the respective cutout in the control cams, i.e., outer peripheral area sections. The control cams are preferably aligned with one another in recto printing and in recto/verso printing so that the cutouts in the control cams do not overlap one another, which would result in the production of a gap in the contour path, which would then be swept over by the follower element during each revolution of the cylinder. The rotary alignment of the control cams in relation to one another is preferably selected so that the contour path is always completely closed, i.e., both in recto printing and in recto/verso printing, and for any format of the sheets to be transferred.

In a preferred embodiment of the transfer device, in order to adjust the opening and closing times of the gripper device in relation to a specific rotary angle position of the cylinder, at least one of the control cams can be rotated with respect to the other control cam. In an advantageous alternative construction, both control cams are centered on the bearing element, so that here rotation of the control cams is carried out about the axis of rotation of the cylinder. The bearing element has a circular cross section, at least in the region of the through openings in the control cams, so that stepless adjustment of the control cams with respect to one another is readily possible.

In an advantageous exemplary embodiment of the transfer device, provision is made for the maximum width of the cutout in the first control cam and/or in the second control cam to be only so great that the wall of the through opening provided in the control cam is interrupted by the cutout over a peripheral range which is less than 180°. The cutout is therefore, firstly, so large that the control cam can be pushed radially, in the direction as referred to the axis of rotation of the cylinder, onto the bearing element, but the dimensions thereof are selected so as to be so small that the peripheral range of the through opening which is available for centering the control cam with respect to the bearing element is still sufficiently large to ensure reliable centering.

Preference is also given to an exemplary embodiment of the transfer device which is distinguished by the fact that the cutout in the first control cam, used for recto printing, is arranged in a peripheral region wherein the gripper device actuated by the follower element does not deliver any printing material during recto printing, preferably being open. In this case, the cutout is located during recto printing at a point at which the gripper device is opened and is therefore inactive; this means that no sheet is held by the gripper device. In the region of this cutout, the pressing force of the follower element on the guide path or paths of the control cam or cams, respectively, is only low. At the point at which the gripper device is open during recto printing, the contour path which is followed by the follower element and which is composed of parts of the respective guide path of the individual control cams, preferably has a lowering region. This may be understood to mean that the gripper device is closed when, based upon the curved course of the contour path, it is at a radially greater distance from the axis of rotation of the cylinder, while it is opened in that region of the contour path which is located closer to the axis of rotation.

According to a development of the invention, provision is made for the first and second control cams to be formed and aligned with one another in the peripheral direction so that the guide paths thereof for the follower element in recto printing and recto/verso printing overlap in at least one peripheral region of the control cams. As a result, it is possible to ensure that the follower element is always supported by at least one of the two cams during a complete revolution of the cylinder. It is also advantageous that further tolerances can be implemented in producing the cutouts in the control cams.

Preference is also given to an exemplary embodiment of the transfer device wherein, in order to align the first and second control cams with one another in the peripheral direction, an actuating drive is provided. As a result, automatic adjustment of the control cams in relation to one another, i.e., setting the opening and closing times of the gripper device, is possible. According to an alternative construction, provision is made for the alignment to be carried out manually, which means that a simpler construction of the transfer device can be implemented. Of course, it is also possible for the actuating drive to offer an option for manual alignment as well.

Furthermore, preference is given to an exemplary embodiment of the transfer device which is distinguished by the fact that the first control cam is fixed to a frame which is in a fixed position, for example, fixed to a side wall of the machine, and the second control cam can be adjusted in the peripheral direction with respect to the first control cam. In this embodiment, therefore, only the second control cam is moved in the peripheral direction in relation to the first control cam in order to adjust the opening and closing times of the gripper device, as referred to the rotary angle position of the cylinder.

In a further embodiment, the second control cam has a toothing system which runs concentrically with respect to the axis of rotation and with which a gearwheel which belongs to the actuating drive and to which a torque can be applied is or can be engaged. Thereby, very exact adjustment of the rotary angle position of the second control cam with respect to the first control cam is possible.

In an advantageous exemplary embodiment of the transfer device, provision is made for each of the first and second control cams, upline and downline of the cutout thereof in the peripheral direction, respectively, to have a lowered portion which is covered by the respective other control cams closing the cutout, which means that the transition from one outer peripheral section of the first control cam to an outer peripheral section of the second control cam, arranged adjacent thereto, is at least approximately stepless. This makes it possible to ensure that the contour path, which is composed of the guide paths of the control cams and is followed by the follower element, has a curved course without edges, so that the actions of opening and closing the gripper device are not carried out abruptly but gradually. In addition, it is possible to ensure that the transition of the follower element from the guide path of one control cam to the guide path of the other control cam also takes place gradually, so that differences in diameter between the control cams resulting during manufacture or assembly are compensated for.

According to a development of the transfer device, at least one stop is provided in order to define the maximum opening position and/or closing position of the gripper device. This makes it possible to ensure that, if there is a gap in the contour path, for example, as a result of an overlapping of the cutouts in the control cams, the opening or closing of the gripper device beyond the normal functional position thereof is avoided. Damage to the gripper device, which, for example, is pivotable about an axis and has a gripper shaft, by other parts of the transfer device can therefore be ruled out.

In an advantageous exemplary embodiment, the cylinder of the transfer device according to the invention is formed by a buffer or storage cylinder, in particular by a storage impression cylinder, at which, during the transfer of the sheet, the sheet resting on the cylinder is printed or varnished by a peripheral region of the cylinder.

In a preferred embodiment, the transfer device is part of a apparatus for turning or reversing the sheets, which, as viewed in the sheet travel direction, has a transfer/turning or reversing drum arranged downline of the cylinder. While the sheet-processing machine is being used for recto printing, the transfer/turning or reversing drum arranged downline of the cylinder serves only for the onward transport of the sheet, which is not turned or reversed. If the machine is set for the recto/verso printing mode, the sheet transferred to the drum by the cylinder is turned or reversed with the aid of the transfer/turning or reversing drum, i.e., the previous trailing edge of said sheet is gripped by a holding device on the turning or reversing drum and then becomes the leading edge, while the previous leading edge of the sheet becomes the trailing edge. It is evident that the transfer device according to the invention can be used universally, i.e., both in machines which are used only for recto or first-form printing or only for verso or perfector printing or for both recto/verso printing or first-form and perfector printing.

Other features which are considered as characteristic for the invention are set forth in the appended claims.

Although the invention is illustrated and described herein as embodied in a device for transferring sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
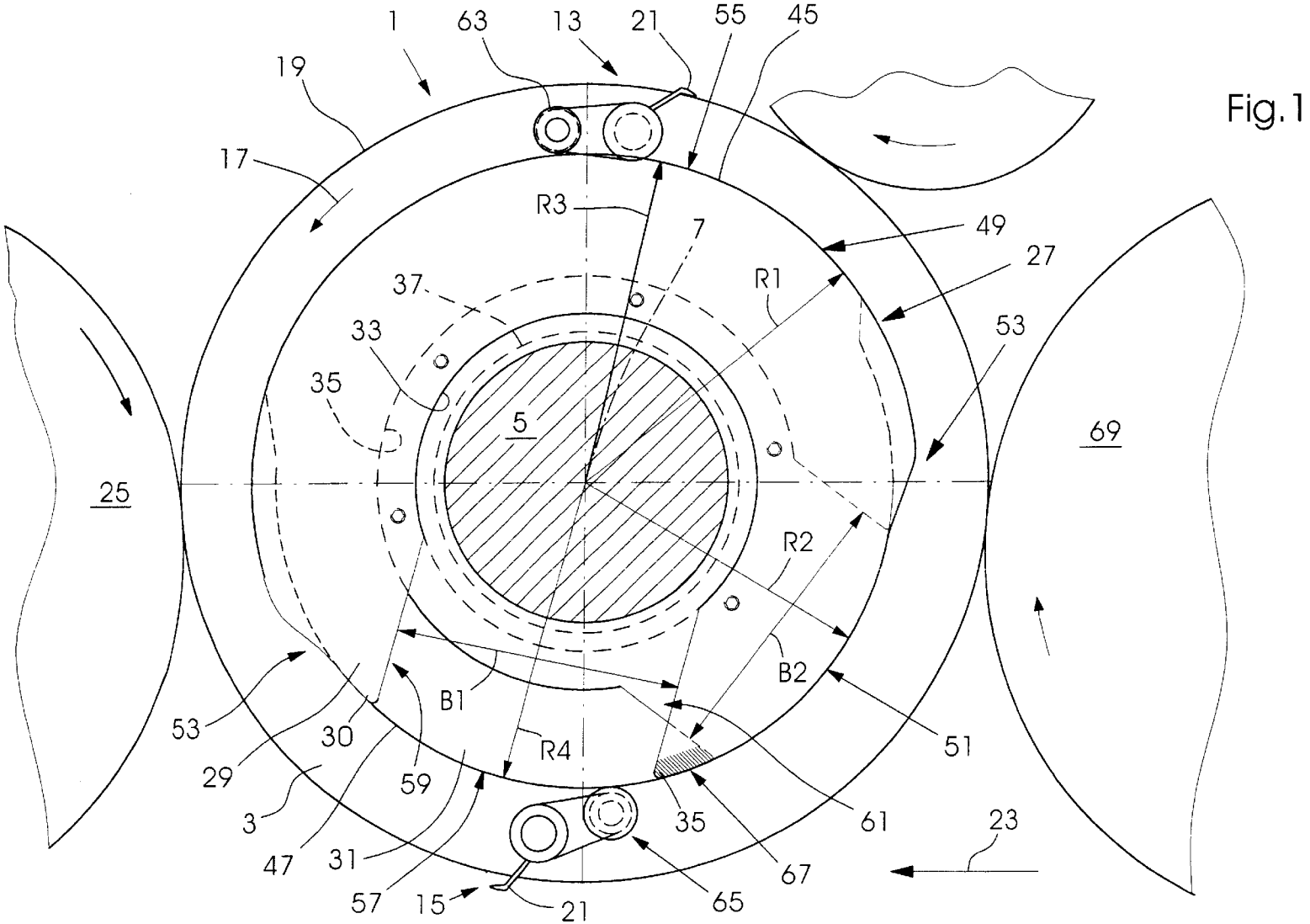
FIG. 1 is a front or end elevational view of an exemplary embodiment of the transfer device according to the invention during recto or first-form printing.

Referring now to the drawings and, first, particularly to FIG. 1 thereof, there is shown therein a transfer device 1 described hereinbelow in greater detail, which serves generally for transferring sheets, for example, paper and cardboard or pasteboard sheets, panels formed of sheet metal and the like, in a sheet-processing machine. Hereinafter, purely by way of example, it is assumed that this is a sheet-fed printing machine, which can be used optionally or selectively for recto printing and for recto/verso or first-form and perfector printing, so that the sheets may be printed or varnished in the machine either on only one side or on both sides thereof.

FIG. 1 thus shows an exemplary embodiment of the transfer device 1 which is installed in the otherwise non-illustrated sheet-fed printing machine, the transfer device 1 having a cylinder 3 which, in this embodiment, is formed by a buffer or storage impression cylinder. Provided at each of the end sides of the cylinder 3 is a bearing element 5 formed by a bearing journal having a circular cross section, of which, in the view according to FIG. 1, only the bearing element 5 can be seen. As is apparent from FIG. 4, which is a cross-sectional view of a detail of the transfer device 1 in the region of the bearing element 5, the bearing element 5 is mounted in a frame 9, which is locally fixed in position, so that the bearing element 5 is rotatable about the longitudinal middle axis/rotational axis 7 of the cylinder 3. Here, a drive pulley 11 provided with the drive of the sheet-fed printing machine is releasably fixed to the end side of the bearing element 5.

The transfer device 1 also has a first gripper device 13 and a second gripper device 15 which, as viewed in the direction of rotation represented by the arrow 17 of the cylinder 3, are arranged at a spacing of 180° from one another in a respective non-illustrated cutout formed open at an edge thereof in the outer peripheral surface 19 of the cylinder 3. The identical gripper devices 13 and 15 here, respectively, have a number of grippers which are arranged at a distance from one another and, as viewed in the direction of the longitudinal mid-axis 7 of the cylinder 3, are arranged behind one another, the grippers serving to grip the non-illustrated sheet to be transferred in a leading-edge region thereof and to fix the respective sheet in an accurate position on the outer peripheral surface 19 of the cylinder 5, so that in-register transfer to a following device in the sheet-fed printing machine can be performed. Of the grippers, only the gripper 21 can be seen in FIG. 1. The gripper devices 13 and 15, respectively, are each formed by a gripper shaft which is mounted in the cylinder 3 so that it is rotatable in a non-illustrated manner.

In order to control the opening and closing of the respective gripper device 13, 15, i.e., the rotary angle position of the cylinder 3 wherein the respective gripper device 13, 15 is closed for gripping and holding a sheet, and the rotary angle position of the cylinder 3 wherein, for transferring the sheet transferred by a peripheral region of the cylinder 3 to a device arranged downline in the sheet running or travel direction represented by the arrow 23, which is formed here by a transfer/turning or reversing drum 25, a control device 27 is provided which has a first control cam 29 and a second control cam 31. The control cams 29 and 31 are constructed as one-piece or integral/unipartite members and have through openings 33 and 35, respectively, through which the bearing element 5 extends when the cams 29 and 31 are assembled or mounted. The control cams 29 and 31 are centered in the frame 9, by a centering ring 37, in relation to an accommodating hole of the bearing for the bearing element 5.

Figure 4:
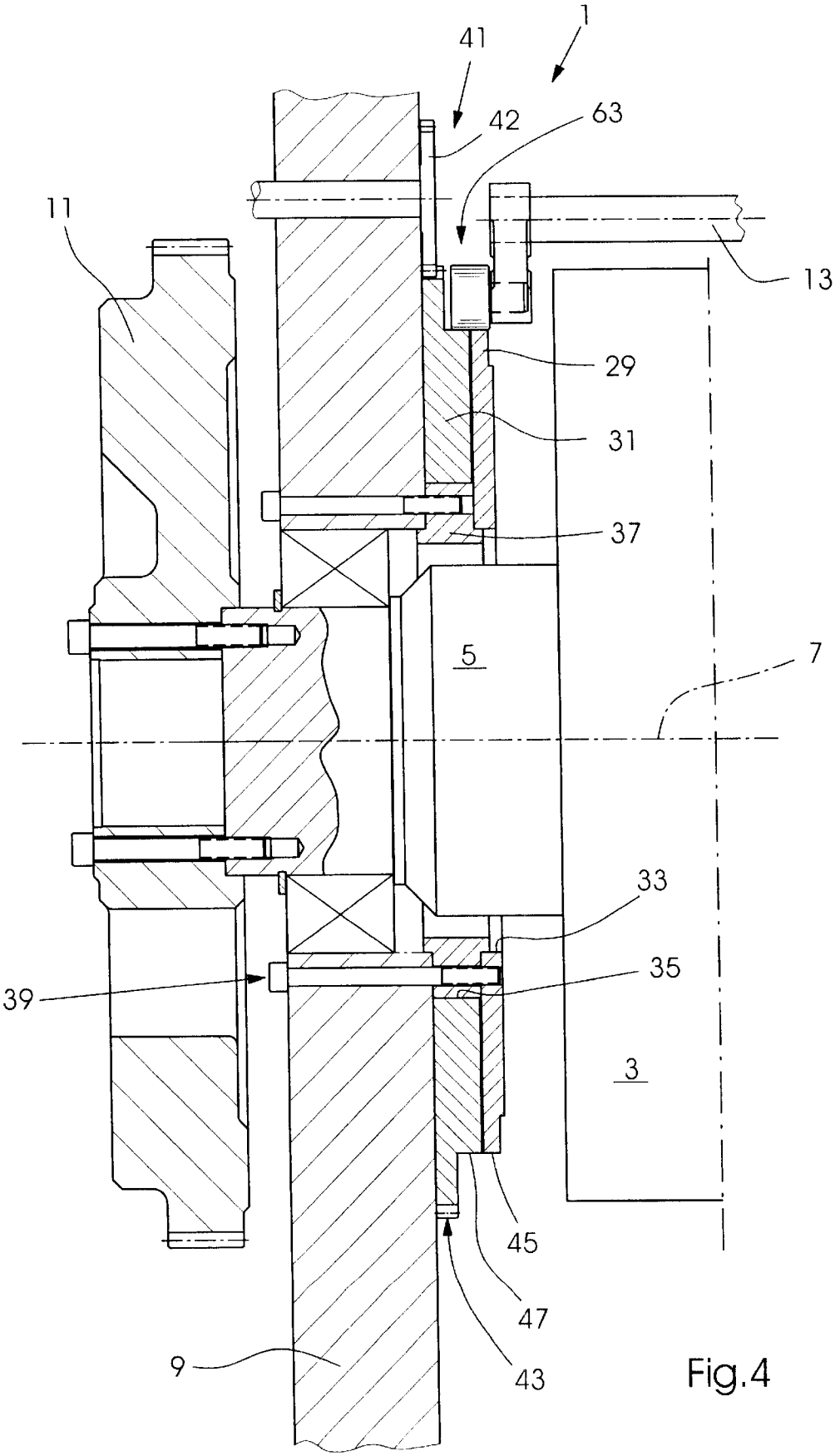
FIG. 4 is a fragmentary longitudinal sectional view of an exemplary embodiment of a cylinder of the transfer device according to FIG. 1.

As is apparent from FIG. 4, the disk-like control cams 29 and 31 bear against one another on the side surfaces thereof, the first control cam 29, arranged adjacent to the cylinder 3, being detachably fixed to the frame 9 with the aid of fasteners 39, which are formed by screws here. The second control cam 31, arranged between the first control cam 29 and the side wall of the frame 9, can be rotated about the axis 7 with respect to the control cam 29 when the latter is fixed. For this purpose, an actuating drive 41 is provided, of which only a gearwheel 42 to which a drive torque can be applied can be seen and which engages with a toothing system 43 provided on the outer periphery of the second control cam 31. In order to pivot or to rotate the second control cam 31 with respect to the first control cam 29 fixed immovably on the frame 9, it is merely necessary for the actuating drive 41 to be activated. There is therefore no need to detach the first control cam 2 from the frame 9 in order to align the rotations of the control cams 29 and 31 in relation to one another.

The control cams 29 and 31, respectively, have a curved outer peripheral surface 45 and 47, respectively. The outer peripheral surface 45 of the first control cam 29 is made up of outer peripheral sections 49 and 51, which here are formed by circular sections of different radius. The outer peripheral section 49 has a radius R1, which is greater than the radius R2 of the outer peripheral section 51, the transition 53 between the outer peripheral sections 49 and 51 being made gradually, i.e., steplessly. The outer peripheral surface 47 of the second control cam 31 is made up of an outer peripheral section 55 with the radius R3 and an outer peripheral section 55 with the radius R4, the transition between the outer peripheral sections 55 and 57 being stepless. As can be seen from FIG. 1, the radii R1 and R3, like the radii R2 and R4 are in each case equally large.

The control cams 29 and 31, respectively, have a respective cutout 59, 61, which is formed in the outer periphery thereof and extends in the control cams 29 and 31, respectively, as far as the through opening 33 and 35, respectively. The inner diameter B1 and B2 of the cutouts 59 and 61, respectively, are greater than the outer diameter of the bearing element 5, so that the control cams 29 and 31, respectively, can readily be pushed onto the bearing element 5 and removed in the radial direction as referred to the longitudinal mid-axis 7 of the cylinder 3. This makes simple assembly and disassembly of the control cams 29 and 31 possible when the cylinder 3 is assembled or mounted. The control cams 29 and 31 are rotated in relation to one another in FIG. 1 so that the outer peripheral section 57 of the second control cam 31 is in an overlapping position with the cutout 59 in the first control cam 31. Because the outer peripheral surfaces 45 and 47 of the control cams 29 and 31, respectively, are each followed by respective follower elements 63 and 65, a closed contour path results for the follower elements 63 and 65, which means that the follower elements 63 and 65 are supported on the outer peripheral surface 47 of the second control cam 31 in the region of the cutout 59, while they bear on the outer peripheral surface 45 of the first control cam 29 in the region of the cutout 61. In this case, upline and downline of the cutout 59 in the peripheral direction, the first control cam 29 has a lowered portion 30 and 35, respectively, (run-off and run-on bevel, respectively) relative to the outer peripheral surface 47 of the second control cam 31. This applies as well to the cutout in the second control cam 31, which is closed by the first control cam 29.

The follower elements 63 and 65, formed by cam rollers here, are coupled to the gripper devices 13 and 15, respectively, so that when the outer peripheral sections 49 and 55, respectively, of the control cams 29 and 31, respectively, are being followed, the respective gripper device is closed and in such a way that, when following the outer peripheral sections 47 and 57 of the control cams 29 and 31, respectively, the respective gripper device is open.

In the position of the cylinder 3 shown in FIG. 1, the first gripper device 13 is closed, i.e., a sheet can be held on the periphery of the cylinder 3, while the second gripper device 15 is open, the associated follower element 65 thereof following a depression formed in the outer peripheral surface 47 of the control cam 31. It can also be seen from FIG. 1 that the guide paths of the control cams 29 and 31 formed by the outer peripheral surfaces 45 and 47, respectively, overlap in a region 67 which is illustrated by hatching.

In FIG. 1, the control cams 29 and 31 are aligned with one another in the peripheral direction for recto printing with the sheet-fed printing machine, wherein only one side of the sheets is printed or varnished. In recto printing, the sheets are not turned or reversed by the transfer/turning or reversing drum 25, but only transported onwardly. Here, because of the curve of the contour path, the gripper devices 13 and 15 are opened in about the 8 o'clock position and closed in about the 3 o'clock position.

FIG. 1 reveals that the arrangement of the cutout 59 on the outer peripheral region 45 of the first control cam 29 is selected so that, during recto printing, it is located on a peripheral region of the contour path whereon the gripper device 13 or 15 actuated by the follower element 63 or 65, respectively, is open. It is also clear that the first control cam 29 performs the complete closing and opening function of the follower elements 63 and 65 during recto printing, while the second control cam 31 is located in a waiting position which is virtually inactive, because the outer peripheral surface 47 thereof does not project in the radial direction beyond the outer peripheral surface 45 of the first control cam 29 at any point. Only that part of the second control cam 31 which overlaps the cutout 59 in the first control cam 29 serves as a support for the follower elements 63 and 65 during recto printing, in order that the contour path be closed.

Figure 2:
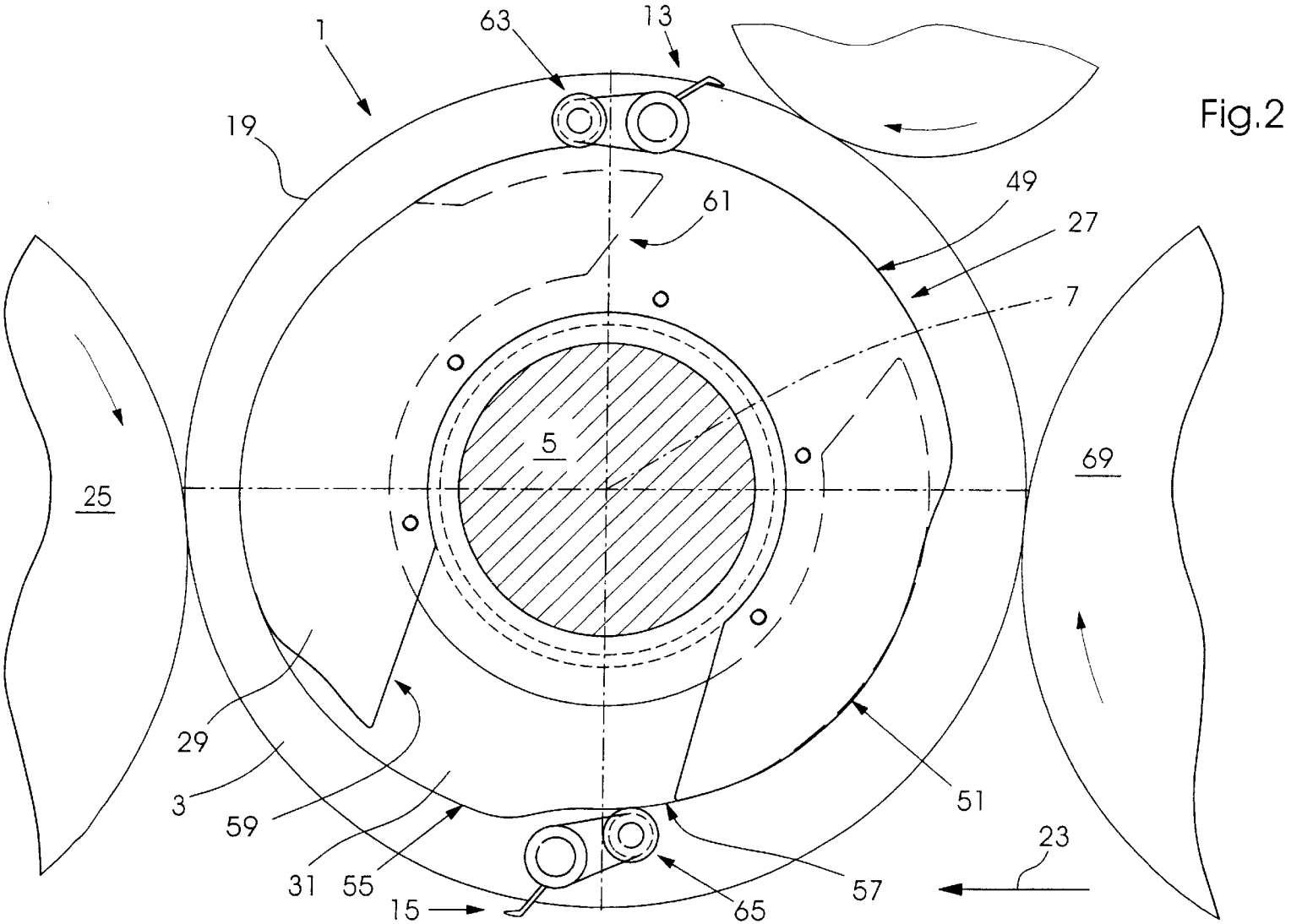
FIGS. 2 and 3 are respective views like that of FIG. 1 of the transfer device during recto/verso or first-form and perfector printing, for different sheet formats.

To convert the transfer device 1 from recto printing to recto/verso printing, the second control cam 31 is pivoted in the counterclockwise direction by the actuating drive 41 about the longitudinal mid-axis 7 with respect to the first control cam 29 arranged fixed to the frame. In FIG. 2, the first and second control cams 29 and 31, respectively, are aligned with respect to one another for the recto/verso or first-form and perfecting modes of operation. In this case, the outer peripheral section 55 of the second control cam 31 overlaps the cutout 59 in the first control cam 29. Because of the contour path, which is changed as a result and is formed of the outer peripheral surfaces 45 and 47, respectively, on the control cams 29 and 31, respectively, the opening and closing times of the gripper devices 13 and 15 are changed, specifically in a way that the gripper devices open later and release the sheet leading edge later during the transfer of the sheet from the cylinder 3 to the transfer/turning or reversing drum 25. This takes place in the aligned position of the control cams 29 and 31 illustrated in FIG. 2 when the gripper device 13, 15 has been moved as far as approximately a 6 o'clock position. The gripper device then releases the leading edge of the sheet, while the trailing edge of the sheet is gripped by a holding device belonging to the transfer/turning or reversing drum 25.

Figure 3:
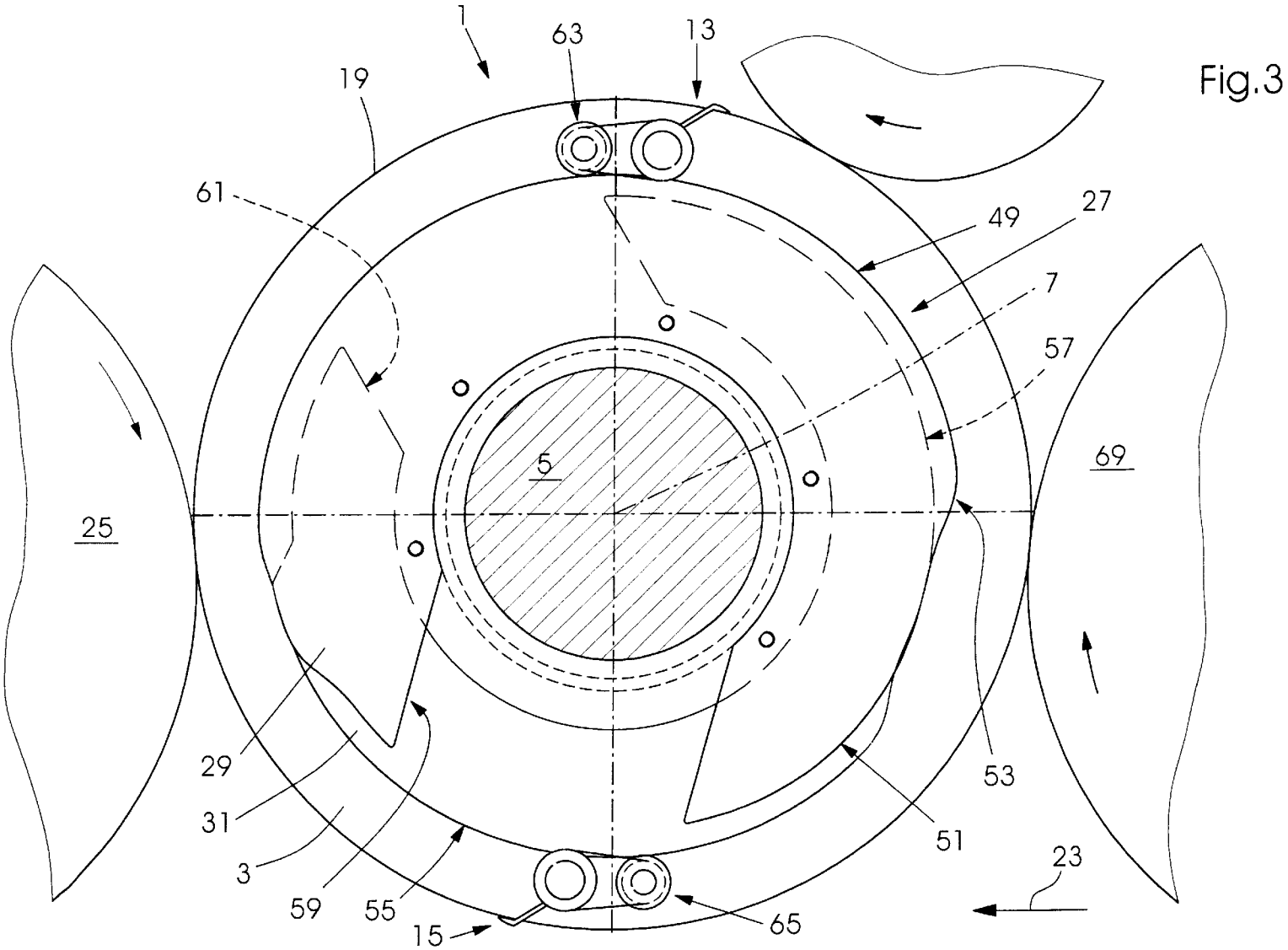

In FIG. 3, the second control cam 31 has been pivoted about 90° in the counterclockwise direction beyond the position illustrated in FIG. 2, as a result of which the contour path followed by the follower elements 63 and 65, respectively, is changed again so that the opening time of the gripper device is now located in a position at approximately 4 o'clock and, therefore, as viewed in the peripheral direction of the contour path, in the immediate vicinity of the closing time of the gripper device, which is disposed, in the region of the transition 53, from the outer peripheral section 51 in approximately the 3 o'clock position with respect to the outer peripheral section 49 of the first control cam 29. The second control cam 31 is aligned with respect to the first control cam 29 in accordance with the format of the sheets to be transported, which means that, in the position of the control cams 29 and 31, respectively, shown in FIG. 3, a considerably longer sheet is transported than in the position shown in FIG. 2.

It is readily clear that, because of the arrangement of the first control cam 29 fixed to the frame, the closing time of the gripper device 13, 15 is unchanged both during recto printing and during recto/verso or first-form and perfector printing. Due to the rotation of the second control cam 31 with respect to the first control cam 29, it is therefore only the opening time which is changed, i.e., the point at which the gripper device opens again so that the sheet can be accepted and transported onward by the transfer/turning or reversing drum 25. Matching the opening and closing times of the gripper device to the format of the sheets is therefore readily possible, as described with regard to FIGS. 2 and 3.

It is to be noted that, in the exemplary embodiment described with respect to FIGS. 1 to 3, the transfer device 1 is part of a turning or reversing device and a transfer/turning or reversing device, respectively, for the sheets, because the transfer/turning or reversing drum 25 is used, either only for transporting the sheets onward (recto printing) or for turning or reversing the sheets (recto/verso printing), depending upon the mode of operation of the sheet-printing machine.

Figure 5A:
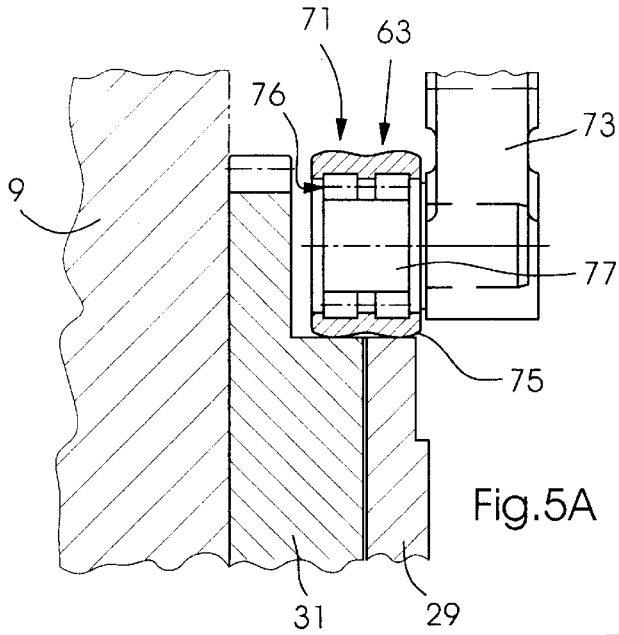
FIG. 5A is an enlarged fragmentary sectional view of FIG. 4 showing a first exemplary embodiment of a follower element following a number of control cams simultaneously.

FIG. 5A shows an exemplary embodiment of the follower element 63, which is formed as a cam roller 71 connected via a pivoting lever 73 to the non-illustrated gripper device, which is mounted on the cylinder 3. The cam roller 71 has a raceway 75 formed of a steel ring, for example, which is in contact with the outer peripheral surfaces 45 and 47 of the control cams 29 and 31, respectively. With the aid of a roller bearing 76, the raceway 75 is mounted so that it can rotate with respect to a pin 77 connected to the pivoting lever 73. The raceway 75 is sufficiently wide for both control cams 29 and 31 to be followed at the same time, as shown in FIG. 5A. Because the control cams 29 and 31 have a curved course on the outer periphery thereof, with high and low points, the distance between the cam roller 71 and the longitudinal mid-axis/rotational axis 7 of the cylinder 3, as in the exemplary embodiment according to FIGS. 1 to 4, is always determined by the outer peripheral section with the respectively greatest radius R, the outer peripheral section belonging either to the control cam 29 or the control cam 31. In FIG. 5A, the radius of the outer peripheral sections of the control cams 29 and 31 is equally large at the point being followed, so that the distance between the cam roller and the rotational axis 7 is defined by both control cams.

Figure 5B:
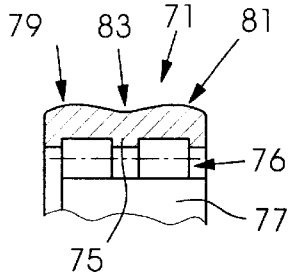
FIG. 5B is a further enlarged, broken-away fragmentary sectional view of FIG. 5A showing the construction of the follower element in greater detail.

FIG. 5B shows, on an enlarged scale, a detail of the cam roller 71 shown in FIG. 5A. It can be seen that, in the regions wherein it rolls on the outer peripheral surfaces 45 and 47 of the control cams 29 and 31, respectively, the raceway 75 is of double-convex form, i.e., has convex curvatures 79 and 81, respectively. Between the convexly curved curvatures 79 and 81 extending over the entire peripheral region of the cam roller 71, a peripheral depression 83 is provided, within which the raceway 75 does not bear on the outer peripheral surfaces of the control cams. The cam roller 71 therefore does not roll on the control cams 29 and 31 with the entire outer peripheral surface thereof. The depression 83 also offers the advantage that, in the transition region between the control cams 29 and 31 adjoining one another laterally, there is no contact between the raceway 75 and the control cams, so that wear on the cam roller 71 at this point, resulting from a gap between the control cams or the like, is avoided.

Figure 7:
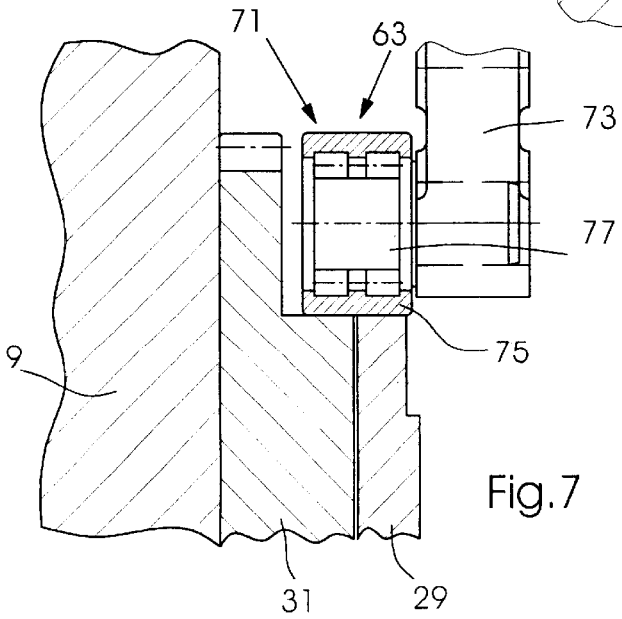

FIG. 7 shows a further exemplary embodiment of the follower element 63, which differs from the follower element described with regard to FIGS. 5A and 5B only in the fact that the cam roller 71 is not of convex form but, as viewed in cross section, has a flat outer peripheral surface, so that, in the aligned position of the control cams 29 and 31 relative to one another as shown in FIG. 7, the cam roller 71 or the raceway 75 bears with the entire width thereof on the outer peripheral surfaces 45 and 47 of the control cams 29 and 31, respectively.

Figure 6:
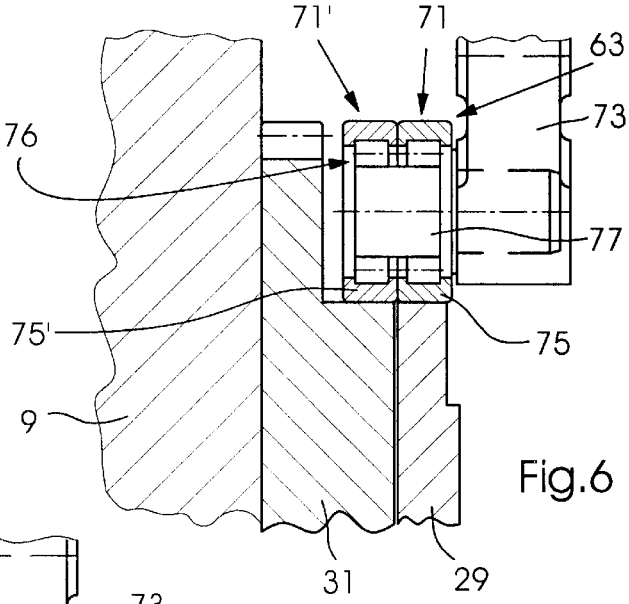
FIGS. 6 and 7 are respective views like that of FIG. 5A, showing further exemplary embodiments, respectively, of the follower element.

FIG. 6 shows a further exemplary embodiment of the follower element 63, which has two cam rollers 71 and 71' which are arranged beside one another and have a common associated roller bearing 76 for mounting them on the pin 77 connected to the pivoting lever 73. The cam roller 71 has a raceway 75 which is associated with the control cam 29, while the cam roller 71' has a raceway 75' which rolls on the outer peripheral surface 47 of the second control cam 31. The raceways 75 and 75' of the cam rollers 71 and 71', respectively, together have a width in this exemplary embodiment which corresponds to that of the cam rollers 71 described with respect to FIGS. 5 and 7.

In summary, it should be noted that, in the transfer device 1 according to the invention, replacing the control cams 29 and 31 is readily possible in that they can be pushed onto or pulled off the bearing element 5 in the radial direction with respect to the axis of rotation 7 of the bearing element 5, in particular with the cylinder 3 in the installed state. In addition, the control cams 29 and 31 can be produced cost-effectively, because they are simple to manufacture due to the one-piece or unipartite configuration thereof.

We claim:

1. A device for transferring sheets in a sheet-processing machine, comprising a cylinder having at least one gripper device for the sheets, and a control device for opening and closing the gripper device, said control device having a first control cam for recto printing and a second control cam for recto/verso printing, at least one follower element for following said first and second control cams, each of said first and second control cams being formed with a through opening for accommodating a bearing element and, respectively, a cutout formed in the periphery of said first and second control cams and extending as far as the through opening for fitting said first and second control cams to and removing them from said bearing element radially, said first and second control cams, respectively, being of integral construction and, in peripheral direction, being aligned with one another so as to provide an at least approximately closed contour path for said at least one follower element.

2. The transfer device according to claim 1, wherein at least one of said first and second control cams is rotatable with respect to the other thereof for adjusting opening and closing times of said gripper device.

3. The transfer device according to claim 1, wherein said cutout formed in at least one of said first and said second control cams has a width which is at least as large as the outer diameter of said bearing element, and is at maximum only sufficiently large for a wall defining said through opening to be interrupted by said cutout over a peripheral range of less than 180°.

4. The transfer device according to claim 1, wherein said gripper device is actuatable by said follower element, and said cutout in said first control for recto printing is disposed in a peripheral region wherein said gripper device actuatable by said follower element is inactive during recto printing.

5. The transfer device according to claim 1, wherein said first and second control cams are formed and aligned with one another in a manner that guide paths thereof for said follower element, in recto printing and recto/verso printing, overlap in at least one peripheral region of said first and second control cams.

6. The transfer device according to claim 1, including an actuating drive for aligning said first and said second control cams with one another in peripheral direction.

7. The transfer device according to claim 1, including structure provided for manually performing the alignment of said first and said second control cams with one another in peripheral direction.

8. The transfer device according to claim 1, wherein said first control cam is fixed to a frame fixed in position, and said second control cam is adjustable in peripheral direction with respect to said first control cam.

9. The transfer device according to claim 6, wherein said second control cam has a toothing system, and said actuating drive has at least one gearwheel to which a torque is applicable and which is one of being engaged with and being engageable with said toothing system.

10. The transfer device according to claim 1, wherein said first and said second control cams, respectively, have at least two outer peripheral sections with different radii, a transition from one of said outer peripheral section to another of said outer peripheral sections disposed adjacent thereto being at least approximately stepless.

11. The transfer device according to claim 10, wherein said outer peripheral sections are circular path sections.

12. The transfer device according to claim 1, including at least one stop for defining at least one of a maximum opening position and a closing position of said gripper device.

13. The transfer device according to claim 1, wherein said cylinder is a storage cylinder.

14. The transfer device according to claim 1, wherein said cylinder is a storage impression cylinder.

15. The transfer device according to claim 1, forming part of a sheet turning or reversing device which, as viewed in the sheet travel direction, has a transfer/turning or reversing drum disposed downline from said cylinder.

16. The transfer device according to claim 1, wherein said follower element is formed by at least two cam rollers disposed adjacent one another, a first one of said cam rollers following said first control cam, and a second one of said cam rollers following said second control cam.

17. The transfer device according to claim 1, wherein said follower element is formed by a wide cam roller for following both said first and said second control cams.

18. The transfer device according to claim 17, wherein said cam roller is of double convex form and, in the peripheral regions, said cam roller rests on contour paths of said first and said second control cams.

19. The transfer device according to claim 1, wherein said first and said second control cams, respectively, in the peripheral direction, upline and downline from said cutout thereof, have a lowered portion with respect to the outer peripheral surface of the respective other control cam.

* * * * *